US006638370B2

(12) United States Patent
Boulos

(10) Patent No.: US 6,638,370 B2
(45) Date of Patent: Oct. 28, 2003

(54) PHOSPHATE CONVERSION COATING PROCESS AND COMPOSITION

(75) Inventor: Mervet S. Boulos, Troy, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/182,289

(22) Filed: Jul. 26, 2002

(65) Prior Publication Data

US 2003/0000418 A1 Jan. 2, 2003

Related U.S. Application Data

(60) Provisional application No. 60/179,047, filed on Jan. 31, 2000.

(51) Int. Cl.[7] ..... C23C 22/05

(52) U.S. Cl. ..... 148/253; 106/14.12; 106/14.44; 148/256; 148/257; 148/259; 148/260; 156/297

(58) Field of Search ..... 106/14.12, 14.44; 148/253, 256, 257, 259, 260; 156/297

(56) References Cited

U.S. PATENT DOCUMENTS

| | | | | |
|---|---|---|---|---|
| 4,865,653 | A | 9/1989 | Kramer | |
| 5,261,973 | A | 11/1993 | Sienkowski et al. | |
| 5,653,790 | A | 8/1997 | Fotinos et al. | |
| 5,797,987 | A | 8/1998 | Rossio | |
| 5,863,357 | A | 1/1999 | Shinomiya et al. | |
| 6,019,858 | A | 2/2000 | Sienkowski et al. | |
| 6,179,934 | B1 | 1/2001 | Kawakami et al. | |
| 6,530,999 | B2 * | 3/2003 | Meagher et al. | 148/262 |

FOREIGN PATENT DOCUMENTS

| | | |
|---|---|---|
| WO | WO98/32894 | 7/1998 |

OTHER PUBLICATIONS

Lorin, Guy; *Phosphating of Metals*, 1974, pp. 196–202 (No Month).

* cited by examiner

*Primary Examiner*—Anthony J. Green
(74) *Attorney, Agent, or Firm*—Stephen D. Harper; Mary K. Cameron

(57) ABSTRACT

By including nitric acid and hydroxylamine in a manganese phosphating composition and controlling the ratio of nitric to phosphoric acids and the ratio of Total Acid to Free Acid within a specified range, satisfactory manganese phosphate conversion coatings can be obtained within a reasonable time at temperatures much lower than has previously been thought necessary for operating a manganese phosphating composition with no other metal cations (except possibly for iron).

17 Claims, No Drawings

PHOSPHATE CONVERSION COATING PROCESS AND COMPOSITION

This application claims priority from International application No. PCT/US01/02923, filed Jan. 29, 2001 and published in English, and from United States provisional application Ser. No. 60/179,047, filed Jan. 31, 2000.

FIELD AND BACKGROUND OF THE INVENTION

This invention relates to compositions and processes for depositing a manganese-containing phosphate conversion coating on metal surfaces, particularly the surfaces of ferrous metals. The invention particularly relates to such compositions and processes that produce, at a temperature not more than 80° C., a conversion coating which is at least one of: (i) suitable, optionally and usually after being lubricated, as a high quality surface that is resistant to wear in sliding contact with other surfaces; and (ii) suitable for forming a strong adhesive bond to rubber, using adhesives established commercially as suitable for this purpose.

The use of manganese phosphate conversion coating to produce wear-resistant surfaces on ferriferous metals is well known in the art. See, e.g., Guy Lorin, *Phosphating of Metals* (Finishing Publications Ltd., Hampton Hill, Middlesex, England, 1974) pp. 193–202. Prior art phosphating compositions for this purpose have been used in practice only at relatively high temperatures, almost always above 80° C. and more often above 90° C., and processes at such high temperatures generally produce copious amounts of undesired sludge. Additionally, such high temperature processes consume more energy than processes operated at relatively low temperatures. However, known low temperature manganese phosphate conversion coating processes provide coatings having inferior properties (particularly wear-resistance). See, for example, id. at 196.

Various alternative and/or concurrent objects of this invention are: (i) to provide a composition and process for phosphating that will provide a high quality wear-resistant coating, optionally after lubrication, at a phosphating temperature that is not more than 80° C.; (ii) to provide relatively economical phosphate conversion coating compositions and processes that will provide as good quality a wear-resistant coating, optionally after lubrication, as currently conventional high temperature processes, by reducing the amount of sludge generated; and (iii) to produce a surface suitable for strong adhesive bonding of the underlying metal substrate to rubber or other elastomers in a composite article. Other more detailed alternative and/or concurrent objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the objects of the invention; the terms "molecule" and "mole" and their grammatical variations may be applied to ionic, elemental, or any other type of chemical entities defined by the number of atoms of each type present therein, as well as to substances with well-defined neutral molecules, and "mole" means specifically "gram mole"; the first definition of an acronym or other abbreviation applies to all subsequent uses herein of the same abbreviation; and the term "polymer" includes "oligomer", "homopolymer", "copolymer", "terpolymer", and the like.

BRIEF SUMMARY OF THE INVENTION

It has been found that one or more of the objects stated above for the invention can be achieved by the use of a conversion coating forming aqueous liquid composition that has a pH of at least 2.0 and comprises water and the following components:

(A) dissolved divalent manganese cations;

(B) dissolved phosphate anions;

(C) dissolved nitrate anions;

(D) at least one dissolved source of hydroxylamine; and, optionally, one or more of the following components:

(E) a component of surfactant molecules that are not part of any of the immediately previously recited components (A) through (D);

(F) buffering agents that are not part of any of the immediately previously recited components (A) through (E);

(G) a component of dissolved iron cations;

(H) a component of dissolved alkali metal and ammonium cations that are not part of any of immediately previously recited components (A) through (G). The term "optionally" is not meant to imply that components other than (A)–(H) can not or should not be present in the aqueous liquid composition.

Various embodiments of the invention include working compositions for direct use in treating metals, make-up concentrates from which such working compositions can be prepared by dilution with water, replenisher concentrates suitable for maintaining optimum performance of working compositions according to the invention, processes for treating metals with a composition according to the invention, and extended processes including additional steps that are conventional per se, such as acid pickling and/or other chemical cleaning, activation with titanium-containing sols (Jernstedt salts) or manganese phosphate sols, rinsing, and subsequent oiling or provision of other lubricant that at least adheres to and preferably is absorbed into the phosphate coating formed. Articles of manufacture including surfaces treated according to a process of the invention are also within the scope of the invention.

DETAILED DESCRIPTION OF THE INVENTION AND PREFERRED EMBODIMENTS

For a variety of reasons, it is sometimes preferred that compositions according to the invention as defined above should be substantially free from many ingredients used in compositions for similar purposes in the prior art. Specifically, when maximum storage stability of a concentrate, avoidance of possibly troublesome anions, and/or minimization of pollution potential is desired, it is preferred, with increasing preference in the order given, independently for each preferably minimized component listed below, that these compositions contain no more than 25, 15, 9, 5, 3, 1.0, 0.35, 0.10, 0.08, 0.04, 0.02, 0.01, 0.001, or 0.0002, percent of each of the following constituents: nitrite; halates and perhalates (i.e., perchlorate, chlorate, iodate, etc.); chloride; bromide; iodide; organic compounds containing nitro groups; organic molecules each of which contains at least two moieties selected from the group consisting of carboxyl, carboxylate, hydroxyl, peroxy, keto, aldehydo, amino, amido, substituted amido, nitrile, substituted amino, thio, ether, thioether, phosphino, and substituted phosphino moieties; hexavalent chromium; manganese in a valence state of four or greater; metal cations, other than manganese and iron, with a valence of two or more; ferricyanide; ferrocyanide; and pyrazole compounds. Furthermore, even though components such as these may not be harmful in some cases, they have not been found to be needed or advantageous in compositions according to this invention, and their minimization may therefore be preferred for economic reasons.

The dissolved divalent manganese cations required for component (A) may be obtained from any soluble manganese salt or from manganese metal itself or any manganese containing compound that reacts with aqueous acid to form dissolved divalent manganese cations. Normally preferred sources, largely for economic reasons, are manganese carbonate and manganese oxide. In a working conversion coating forming aqueous liquid composition according to the invention, the concentration of dissolved divalent manganese cations preferably is at least, with increasing preference in the order given, 0.40, 0.60, 0.80, 1.00, 1.40, 1.7, 1.9, 2.1, 2.3, or 2.5 grams of $Mn^{+2}$ per liter of working composition (this concentration unit being hereinafter freely applied to the concentration of any constituent in any liquid composition and being hereinafter usually abbreviated as "g/l") and independently preferably is not more than, with increasing preference in the order given, 15,12, 9.0, 7.0, 6.0, 5.5, 5.1, 4.8, 4.5, or 4.3 g/l. Smaller concentrations than the smallest of those recited as preferred minimums above generally do not produce satisfactory coatings in a reasonable time. Larger concentrations than the largest of those recited as preferred maximums above generally do not produce any quality improvement in the coatings formed and are therefore uneconomical.

The dissolved phosphate ions of component (B) also may be obtained from a variety of sources as known in the general phosphate conversion coating art. Because of a preference noted below for a substantial amount of total acid in a working conversion coating forming aqueous liquid composition according to the invention, normally much of the phosphate ions content will preferably be supplied by phosphoric acid added to the composition, and the stoichiometric equivalent as phosphate ions of all undissociated phosphoric acid and all its anionic ionization products in solution, along with the stoichiometric equivalent as phosphate ions of any dihydrogen phosphate, monohydrogen phosphate, or completely neutralized phosphate ions added to the composition in salt form, are to be understood as forming part of component (B), irrespective of the actual degree of ionization that exists in the composition. The stoichiometric equivalent, the stoichiometry being based on equivalent numbers of phosphorus atoms, as phosphate ions of any condensed phosphoric acid and wholly or partially neutralized salt thereof that may be present in or added to the composition is similarly also to be considered as part of component (B), but ordinarily, at least for economy, only orthophosphoric acid and its salts are preferably used to constitute component (B).

In a working conversion coating forming aqueous liquid composition according to the invention, the concentration of component (B) preferably is at least, with increasing preference in the order given, 2, 4, 6, 8,10,12.0,13.0, 13.4,13.6, 13.8, 14.0, or 14.2 g/l and independently preferably is not more than, with increasing preference in the order given, 100, 75, 50, 45, 40, 35, 30, 28, 26, 24, 22, 20, or 18 g/l. Furthermore, irrespective of the actual concentrations of either component (B) or component (A), the ratio of component (A) to component (B) preferably is at least, with increasing preference in the order given, 0.05:1.00, 0.07:1.00, 0.09:1.00, 0.11:1.00, 0.13:1.00, 0.15:1.00, or 0.17:1.00 and independently preferably is not more than, with increasing preference in the order given, 0.8:1.00, 0.6:1.00, 0.40:1.00, 0.30:1.00, 0.27:1.00, 0.24:1.00, 0.22:1.00, or 0.20:1.00.

Component (C) of nitrate ions is preferably derived from aqueous nitric acid solutions but may also be provided wholly or in part by salts of nitric acid if the desired free and total acid values are provided to the composition from other sources. The stoichiometric equivalent as nitrate ions of all nitric acid and its salts added to or present in a composition according to the invention is to be considered present as nitrate ions for the purpose of calculating the concentration of nitrate ions in the composition, this concentration preferably being at least, with increasing preference in the order given, 0.5, 1.0, 2.0, 3.0, 3.5, 4.0, 4.5, 4.7, 4.9, or 5.1 g/l and independently preferably being not more than, with increasing preference in the order given, 30, 25, 20, 18, 16, 14, 12, 10.0, 9.0, 8.0, 7.0, 6.5, 6.2, or 6.0 g/l. Furthermore, irrespective of their actual concentrations, the ratio of the concentration of component (C) to component (B) preferably is at least, with increasing preference in the order given, 0.10:1.00, 0.15:1.00, 0.20:1.00, 0.25:1.00, 0.27:1.00, 0.29:1.00, 0.31:1.00, 0.33:1.00, or 0.35:1.00 and independently preferably is not more than, with increasing preference in the order given, 0.75:1.00, 0.60:1.00, 0.50:1.00, 0.48:1.00, 0.46:1.00, 0.44:1.00, 0.42:1.00, 0.40: 1.00, or 0.38:1.00.

Component (D) preferably is selected from the group consisting of water soluble salts of hydroxylamine and compounds such as oximes that readily hydrolyze to produce hydroxylamine in working compositions according to the invention, because hydroxylamine itself is somewhat less stable and more hazardous than these other sources, which are believed to exist in solution in equilibrium with a relatively small concentration of free hydroxylamine that is rapidly regenerated from the dissolved source if the free hydroxylamine is depleted. Because of economy, convenience, and established storage stability, hydroxylamine nitrate and hydroxylamine sulfate salts are more preferred for component (D), the latter being most preferred. Irrespective of the chemical nature of the source, however, the concentration of component (D) is to be calculated as the stoichiometric equivalent as hydroxylamine of all sources of hydroxylamine present, irrespective of the actual degree of any dissociation, hydrolysis, complex formation, or the like that may prevail in the actual composition. This concentration of component (D) in a working composition according to the invention preferably is at least, with increasing preference in the order given, 0.03, 0.06, 0.09, 0.12, 0.15, 0.18, 0.21, 0.24, 0.27, or 0.29 g/l and independently preferably is not more than, with increasing preference in the order given, 2.0, 1.0, 0.80, 0.60, 0.55, 0.50, 0.45, 0.40, 0.37, or 0.34 g/l.

A working conversion coating forming aqueous liquid composition according to the invention preferably includes a sufficient amount of optional surfactant component (E) to assure facile wetting of the substrate. One or more complex phosphonic acids are most preferably used, but a wide variety of surfactants are suitable. As a general guideline, the concentration of component (E) in a working composition according to the invention preferably is at least, with increasing preference in the order given, 0.002, 0.005, 0.008, 0.0110, 0.0120, 0.0130, 0.0140, or 0.0150 g/l and independently preferably is not more than, with increasing preference in the order given, 0.5, 0.3, 0.20, 0.15, 0.10, 0.080, 0.060, 0.050, 0.040, 0.030, 0.025, 0.020 g/l.

A buffering effect is ordinarily and preferably provided in a composition according to the invention by a combination of phosphoric acid and its salts, the latter being conveniently provided in situ by addition of at least one suitable alkalinizing agent such as alkali metal hydroxides and carbonates and ammonium hydroxide, the latter being most preferred. (This also provides optional component (H) to the composition.) As is conventional in the phosphating art, the acidity of a working phosphating composition is preferably controlled by controlling the values of Free Acid and Total Acid "points". Both values are defined by titration of a 10 milliliter (this unit of volume, in either singular or plural, being hereinafter usually abbreviated as "ml") sample of the composition with 0.100 N strong base such as sodium hydroxide. Free Acid points are defined as equal to the number of ml of this titrant required to reach a pH value of 3.8 (which may be measured with a pH meter or an indicator such as bromphenol blue) and Total Acid points are defined as equal to the number of ml of this titrant required to reach a pH value of 8.0 (which may be measured with a pH meter or an indicator such as phenolphthalein).

A working composition according to this invention preferably has a Free Acid value that is at least, with increasing preference in the order given, 1.0, 1.5, 1.8, 2.0, 2.2, or 2.4 points and independently preferably is not more than, with increasing preference in the order given, 15, 13, 11, 10.0, 9.5, 9.0, 8.5, 8.0, 7.5, 7.0, 6.5, 6.0, 5.5, or 5.0 points. Independently, a working composition according to this invention preferably has a Total Acid value that is at least, with increasing preference in the order given, 25, 29, 31, 33, 35, 37, or 39 points and independently preferably is not more than, with increasing preference in the order given, 75, 65, 55, 51, 49, 47, 45, 43, or 41 points. Furthermore, independently of the actual values, the ratio of Total Acid points to Free Acid points preferably is at least, with increasing preference in the order given, 8.0:1.00, 9.0:1.00, 10.0:1.00, 11.0:1.00, or 12.0:1.00 and independently preferably is not more than, with increasing preference in the order given, 35:1.00, 30:1.00, 25:1.00, 23:1.00, 21.1.00, or 19:1.00.

Dissolved iron cations, optional component (G), are a practically unavoidable constituent of a phosphating composition according to the invention after it has been used to phosphate most ferriferous substrates. This constituent is not generally desirable but can be tolerated up to a concentration of at least 30 g/l, and in some instances it may be preferable to include some dissolved iron cations in a freshly made working composition according to the invention, so that the initially obtained properties of the coating will be closer to those obtained after the working composition has been used for some time. When necessary or desirable, iron cations can be removed from used working compositions according to the invention by various means known to those skilled in the art.

One special embodiment of the invention is a liquid make-up concentrate from which a preferred working composition according to the invention can be made by dilution with water only, or by dilution with water combined with addition of an acid or, more often, an alkalinizing agent in order to adjust the Free Acid and Total Acid values to a desired range. Such a liquid make-up concentrate preferably comprises water and the following components:

(A') a concentration of dissolved divalent manganese cations that is at least, with increasing preference in the order given, 5, 10, 15, 20, 25, 30, 35, or 40 parts of divalent manganese cations per thousand parts of the total concentrate, this unit of concentration being hereinafter freely used for any constituent in any composition and being usually abbreviated as "ppt";

(B') a concentration of dissolved phosphate anions that is at least, with increasing preference in the order given, 25, 50, 75, 100, 125,150, 175, 185, 195, 205, 215, 225, or 230 ppt;

(C') a concentration of dissolved nitrate anions that is at least, with increasing preference in the order given, 10, 20, 30, 40, 50, 60, 70, 74, 78, 82, 84, 86, or 88 ppt; and (D') a stoichiometric equivalent concentration as hydroxylamine that is at least, with increasing preference in the order given, 0.30, 0.50, 0.75, 1.0, 1.5, 2.0, 2.5, 2.8, or 3.1 ppt; and, optionally, one or more of the following components:

(E') a component of surfactant molecules that are not part of any of the immediately previously recited components (A') through (D');

(F') buffering agents that are not part of any of the immediately previously recited components (A') through (E');

(G') a component of dissolved iron cations;

(H') a component of dissolved alkali metal and ammonium cations that are not part of any of immediately previously recited components (A') through (G').

Alternatively, a preferred single package make-up concentrate according to the invention may be made by mixing with water, in an amount sufficient to bring the total amount of the concentrate to 1000 parts, the following amounts of at least the following materials:

(A") an amount of manganese oxide that is at least, with increasing preference in the order given, 6, 13, 20, 26, 32, 39, 45, or 52 parts;

(B") an amount of orthophosphoric acid that is at least, with increasing preference in the order given, 26, 52, 77,103,129,155, 180, 191, 201, 211, 221, 232, or 237 parts;

(C") an amount of nitric acid that is at least, with increasing preference in the order given, 10, 20, 30, 41, 51, 61, 71, 75, 79, 83, 85, 87, or 89 parts; (D") an amount of hydroxylamine sulfate that is at least, with increasing preference in the order given, 0.74, 1.24, 1.86, 2.5, 3.7, 5.0, 6.2, 7.0, or 7.7 parts; and, optionally (E") an amount of phosphonic acid surfactant that is, at least, with increasing preference in the order given, 0.02, 0.05, 0.08, 0.11, 0.14, 0.17, or 0.19 ppt; and (F") an amount of dissolved ammonia that is at least, 5, 10, 15, 20, or 25 parts.

In addition and independently, the preferred ratios among ingredients as stated above for working compositions apply, mutatis mutandis, to make-up concentrates for them.

At least manganese and phosphate ions are lost from a working composition according to the invention by incorporation into the coatings formed on the substrates with which it is in contact. Other constituents may be lost by dragout. It is therefore highly preferred, when operating a process according to the invention for a substantial length of time, to replenish the constituents thus lost. Ideally, replenishment should be continuous, but in practice fully satisfactory results can be obtained by establishing lower limit thresholds for critical constituents and adding replenisher whenever values fall below those limits in discrete measurements.

The actual conversion coating forming step in a process according to this invention preferably is performed at a temperature that is at least, with increasing preference in the order given, 48, 53, 57, 60, or 63° C. and independently preferably is, primarily for economy, not more than, with increasing preference in the order given, 75, 70, 68, or 66° C.

A process according to this invention preferably produces a coating mass per unit area of substrate coated, this value being more frequently denoted as "coating weight" for brevity, that is at least, with increasing preference in the order given, 1.0, 1.5, 2.0, 2.2, 2.4, or 2.6 grams per square meter (this unit being hereinafter usually abbreviated as "$g/m^2$") and independently preferably is not more than 10, 8.0, 7.0, 6.0, 5.5, 5.0, or 4.5 $g/m^2$. The coating weight tends to rise as dissolved iron cations accumulate in a working composition during use. Independently, a preferred coating weight as described immediately above is produced in a coating time that is not greater than, with increasing preference in the order given, 60, 50, 30, 20, or 15 minutes.

A substrate to be conversion coated according to this invention is preferably first cleaned and "conditioned" prior to the conversion coating, in a manner known per se in the art, before beginning the actual conversion coating process. Preferably, at least three operations, chemical cleaning, rinsing, and conditioning are employed prior to conversion coating by a process according to the invention. If a surface conversion coated according to the invention is to be employed for its resistance to sliding friction as is most common, the surface preferably is treated with a suitable lubricant, optionally after being rinsed, as known per se in prior art. More specifically preferred but non-limiting methods of pretreatment before and post-treatment after the characteristic phosphating operation according to this invention are described in the working examples.

The practice of this invention may be further appreciated by consideration of the following, non-limiting, working examples.

EXAMPLE 1

Gears in the course of manufacture were processed by the following sequence of operations (all materials identified by trademarks followed by the symbol "®" are available commercially from the Henkel Surface Technologies Division of Henkel Corporation, Madison Heights, Mich.):

1. Chemically clean with a 4% by volume solution in water of PARCO® Cleaner 2090 concentrate for 4.0 minutes (hereinafter usually abbreviated as "min") at 63° C.
2. Rinse with warm water for 30 seconds (hereinafter usually abbreviated as "sec").
3. Condition by contacting for 30 sec at 77° C. with a solution in water containing 4 g/l of FIXODINE® M manganese phosphating conditioner concentrate.
4. Conversion coat in a characteristic process according to this invention by contact for 11.0 min at 63° C. with a solution in water of a concentrate made by mixing the following ingredients in the order shown: 200 parts of tap water; 328 parts of an aqueous phosphoric acid solution containing 75% of $H_3PO_4$; 0.2 parts of RHODAFAC™ RR 710 complex organic phosphate ester surfactant, commercially supplied by Rohm & Haas; 24 parts of an aqueous solution containing 30% of hydroxylamine sulfate; 55 parts of solid MnO; 130 parts of an aqueous solution of $HNO_3$ containing 69.7% of $HNO_3$; and 172.8 parts of tap water. This concentrate was diluted with water only and then adjusted with sodium hydroxide if necessary to produce a working composition with 4.6 Free Acid points and 56 Total Acid points.
5. Rinse with cold water.
6. Apply to the rinsed substrates a 4.0% by volume solution of CUTLASS® 5600D lubricating oil at normal ambient human comfort temperature (18–23° C.) and allow to air dry.

A coating weight of 4.3 to 4.9 $g/m^2$ was obtained during the phosphating operation. The gears thus prepared passed commercially used tests for adequate sliding friction wear resistance.

EXAMPLE 2

In this example steel substrates, some of which had slightly rusted areas, were processed by the following sequence of operations:

1. Chemically clean with a 2.0% by volume solution in water of PARCO® Cleaner 2090 concentrate for 2.0 min at 71° C.
2. Rinse with warm water for 2.0 min.
3. Condition by contacting for 2.0 min at 60° C. with a solution in water containing 4 g/l of FIXODINE® M manganese phosphating conditioner concentrate.
4. Conversion coat in a characteristic process according to this invention by contact for 9.0 min at 63° C. with a solution in water of the same concentrate as used in Example 1; for this example, however, this concentrate was diluted with water only and adjusted with sodium hydroxide if needed to produce a working composition with 2.5 Free Acid points and 46 Total Acid points.
5. Rinse with cold water for 2 min.
6. Apply to the rinsed substrates a 5.0% by volume solution of P3® PREVOX®-505 lubricating and rust-preventing oil concentrate for 2.0 min at 82° C., then allow to air dry. A coating weight of 3.8 $g/m^2$ was obtained during the phosphating operation of the process sequence above. The substrates thus prepared passed commercially used tests for sliding friction wear resistance.

EXAMPLE 3

In this example steel substrates were processed by the following sequence of operations:

1. Chemically clean with a 4.0% by volume solution in water of PARCO® Cleaner 2090 concentrate for 4.0 min at 63° C.
2. Rinse with warm water for 30 sec.
3. Pickle for 5.0 min at normal ambient human comfort temperature in a solution in water of 40% of DEOXYLYTE® 182A concentrate.

4. Rinse with cold water for 30 sec.
5. Condition by contacting for 30 sec at 66° C. with a solution in water containing 4 g/l of FIXODINE® M manganese phosphating conditioner concentrate.
6. Conversion coat in a characteristic process according to this invention by contact for 15 min at 63° C. with a solution in water of the same concentrate as used in Example 1; for this example, however, this concentrate was diluted with water only and then adjusted with sodium hydroxide if needed only to produce a working composition with 2.5 Free Acid points and 38 Total Acid points.
7. Rinse with cold water for 30 sec.
8. Apply to the rinsed substrates a 0.50% by volume solution of PARCOLENE® 99A phosphating post-treatment concentrate and dry into place on the surface. A coating weight of 3.2 g/m$^2$ was obtained during the phosphating operation of the process sequence above. The substrates thus prepared were successfully bonded to rubber, using established commercial adhesives for this purpose.

What is claimed is:

1. An aqueous liquid composition of matter that will form a conversion coating by spontaneous chemical reaction on a ferriferous substrate that is contacted with said liquid composition at a temperature that is not more than 80° C., said liquid composition comprising water and the following components:

(A) dissolved divalent manganese cations at a concentration of at least about 0.40 g/l;

(B) dissolved phosphate anions at a concentration of at least about 2 g/l;

(C) dissolved nitrate anions; and (D) at least one dissolved source of hydroxylamine, at a stoichiometric equivalent concentration as hydroxylamine of all of the dissolved sources of hydroxylamine present in the composition of at least about 0.03 g/l;

wherein the ratio by weight of nitrate anions to phosphate anions is from about 0.10:1.00 to 0.75:1.00; and the Free Acid content is from about 2.2 to about 15 points.

2. An aqueous liquid composition according to claim 1, wherein:

the concentration of dissolved divalent manganese cations is at least about 1.00 g/l;

the concentration of dissolved phosphate anions is at least about 6 g/l;

the concentration of dissolved nitrate anions is at least about 2.0 g/l;

the stoichiometric equivalent concentration as hydroxylamine of all of the dissolved sources of hydroxylamine present in the composition is at least about 0.09 g/l; and the Total Acid content is from about 25 to about 75 points.

3. An aqueous liquid composition according to claim 2, wherein:

the ratio of the concentration of dissolved divalent manganese cations to the concentration of dissolved phosphate anions is from about 0.09:1.00 to about 0.27:1.00;

the ratio of the concentration of dissolved nitrate anions to the concentration of dissolved phosphate anions is from about 0.20:1.00 to about 0.50:1.00; and the ratio of the total acid content to the free acid content is from about 8.0:1.00 to about 30:1.00.

4. An aqueous liquid composition according to claim 3, additionally comprising at least about 0.008 g/l of surfactant that is not part of any of components (A) through (D).

5. An aqueous liquid composition according to claim 4, wherein:

the concentration of dissolved divalent manganese cations is from about 2.5 to about 4.3 g/l;

the concentration of dissolved phosphate anions is from about 14 to about 20 g/l;

the concentration of dissolved nitrate anions is from about 4.9 to about 6.2 g/l;

the stoichiometric equivalent concentration as hydroxylamine of all of the dissolved sources of hydroxylamine present in the composition is from about 0.27 to about 0.37 g/l;

the Free Acid content is from about 2.4 to about 5.0 points;

the Total Acid content is from about 35 to about 45 points;

the ratio of the concentration of dissolved divalent manganese cations to the concentration of dissolved phosphate anions is from about 0.15:1.00 to about 0.24:1.00;

the ratio of the concentration of dissolved nitrate anions to the concentration of dissolved phosphate anions is from about 0.29:1.00 to about 0.42:1.00; and the ratio of the total acid content to the free acid content is from about 12.0:1.00 to about 19:1.00.

6. A process of forming a conversion coating on a ferriferous substrate by contacting the substrate with a composition according to claim 1.

7. A process according to claim 6 that forms a coating with a mass from about 2.0 to about 6.0 g/m$^2$ during a contact time between the substrate and the aqueous liquid composition that is not more than about 20 minutes.

8. A process according to claim 7, wherein the temperature of the aqueous liquid composition is maintained during its contact with the substrate at a temperature that is not greater than about 66° C.

9. A make-up concentrate composition from which a composition according to claim 1 can be made by dilution with water only, said make-up concentrate composition comprising water and:

(A') a concentration of dissolved divalent manganese cations that is at least about 20 parts per thousand;

(B') a concentration of dissolved phosphate anions that is at least about 100 parts per thousand;

(C') a concentration of dissolved nitrate anions that is at least about 40 parts per thousand; and (D') a stoichiometric equivalent concentration as hydroxylamine that is at least about 1.0 parts per thousand.

10. An aqueous liquid composition of matter that will form a conversion coating by spontaneous chemical reaction on a ferriferous substrate that is contacted with said liquid composition at a temperature that is not more than 800° C., said liquid composition having been made by mixing with water at least the following components:

(A) a source of dissolved divialent manganese cations mixed in an amount sufficient to supply at least about 0.40 g/l of dissolved divalent manganese cations to the aqueous liquid composition;

(B) a source of dissolved phosphate anions mixed in an amount sufficient to supply at least about 2 g/l of dissolved phosphate anions to the aqueous liquid composition;

(C) a source of dissolved nitrate anions; and (D) at least one source of dissolved hydroxylamine mixed in an amount sufficient to supply a stoichiometric equivalent concentration as hydroxylamine that is at least about 0.03 g/l in the aqueous liquid composition;

wherein the ratio by weight of the mass of nitrate anions supplied by the source thereof to the mass of phosphate anions supplied by the source thereof is from about 0.10:1.00 to 0.75:1.00; and the Free Acid content is from about 2.2 to about 15 points.

11. An aqueous liquid composition according to claim 10, wherein:

the source of dissolved divalent manganese cations is mixed in an amount sufficient to supply at least about 1.00 g/l of dissolved divalent manganese cations to the aqueous liquid composition;

the source of dissolved phosphate anions is mixed in an amount sufficient to supply at least about 6 g/l of dissolved phosphate anions to the aqueous liquid composition;

the source of dissolved nitrate anions is mixed in an amount sufficient to supply at least about 2.0 g/l of dissolved nitrate anions to the aqueous liquid composition;

the source of dissolved hydroxylamine is mixed in an amount sufficient to supply a stoichiometric equivalent concentration as hydroxylamine that is at least about 0.09 g/l in the aqueous liquid composition; and the Total Acid content is from about 25 to about 75 points.

12. An aqueous liquid composition according to claim 11, wherein:

the ratio of the mass of dissolved divalent manganese cations supplied by the source thereof to the mass of dissolved phosphate anions supplied by the source thereof is from about 0.09:1.00 to about 0.27:1.00;

the ratio of the concentration of dissolved nitrate anions to the concentration of dissolved phosphate anions is from about 0.20:1.00 to about 0.50:1.00; and the ratio of the total acid content to the free acid content is from about 8.0:1.00 to about 30:1.00.

13. An aqueous liquid composition according to claim 12, wherein there is additionally mixed a sufficient amount of surfactant that is not part of any of components (A) through (D) to supply at least about 0.008 g/l of said surfactant to the aqueous liquid composition.

14. An aqueous liquid composition according to claim 13, wherein:

the source of dissolved divalent manganese cations supplies these cations to the composition in an amount corresponding to a concentration from about 2.5 to about 4.3 g/l of divalent manganese cations in the aqueous liquid composition;

the source of dissolved phosphate anions supplies these anions to the composition in an amount corresponding to a concentration from about 14 to about 20 g/l;

the source of dissolved nitrate anions supplies these anions to the composition in an amount corresponding to a concentration from about 4.9 to about 6.2 g/l;

the source of dissolved hydroxylamine supplies to the composition a stoichiometric equivalent concentration as hydroxylamine that is from about 0.27 to about 0.37 g/l;

the Free Acid content is from about 2.4 to about 5.0 points;

the Total Acid content is from about 35 to about 45 points;

the ratio of the mass of dissolved divalent manganese cations supplied by the source thereof to the mass of dissolved phosphate anions supplied by the source thereof is from about 0.15:1.00 to about 0.24:1.00;

the ratio of the mass of dissolved nitrate anions supplied by the source thereof to the mass of dissolved phosphate anions supplied by the source thereof is from about 0.29:1.00 to about 0.42:1.00; and the ratio of the total acid content to the free acid content is from about 12.0:1.00 to about 19:1.00.

15. A make-up concentrate composition from which a composition according to claim 10 can be made by dilution with water only, said composition having been made by mixing with water, in an amount sufficient to bring the total amount of the concentrate to 1000 parts, the following amounts of at least the following materials:

(A") an amount of manganese oxide that is at least about 20 pads;

(B") an amount of orthophosphoric acid that is at least about 129 parts;

(C") an amount of nitric acid that is at least about 51 parts; and (D") an amount of hydroxylamine sulfate that is at least about 2.5 parts.

16. A make-up concentrate composition from which a conversion coating composition can be made by dilution with water only, said make-up concentrate composition comprising water and:

(A') a concentration of dissolved divalent manganese cations that is at least about 20 parts per thousand;

(B') a concentration of dissolved phosphate anions that is at least about 100 parts per thousand;

(C') a concentration of dissolved nitrate anions that is at least about 40 parts per thousand;

(D') a stoichiometric equivalent concentration as hydroxylamine that is at least about 1-0 parts per thousand; and (E') a concentration of dissolved metal cations, other than manganese and iron, with a valence of two or more, that is no more than 1.0 percent.

17. A process of bonding a ferriferous substrate to a rubber substrate comprising the steps of:

(A) contacting the ferriferous substrate with a liquid composition at a temperature that is not more than 80° C. comprising water and the following components:

(1) dissolved divalent manganese cations at a concentration of at least about 1.00 g/l;

(2) dissolved phosphate anions at a concentration of at least about 6 g/l;

(3) dissolved nitrate anions; and (4) at least one dissolved source of hydroxylamine at a stoichiometric equivalent concentration as hydroxylamine of at least about 0.09 g/l;

wherein the ratio by weight of nitrate anions to phosphate anions is from about 0.10:1.00 to 0.75:1.00, to form a conversion coating on the ferriferous substrate; and (B) adhering the rubber substrate to the ferriferous substrate having the conversion coating thereon using an adhesive.

* * * * *

UNITED STATES PATENT AND TRADEMARK OFFICE

CERTIFICATE OF CORRECTION

PATENT NO. : 6,638,370 B2
APPLICATION NO. : 10/182289
DATED : October 28, 2003
INVENTOR(S) : Boulos It is certified that error appears in the above-identified patent and that said Letters Patent is hereby corrected as shown below:

Column 10, line 60, delete “divialent” and insert therefor --divalent--.

Column 12, line 41, delete “1-0” and insert therefor --1.0--.

Signed and Sealed this

Twenty-seventh Day of February, 2007

JON W. DUDAS
*Director of the United States Patent and Trademark Office*